US005425613A

United States Patent [19]

Osborn

[11] Patent Number: 5,425,613

[45] Date of Patent: Jun. 20, 1995

[54] APPARATUS FOR LIFTING AND DUMPING A RECEPTACLE

[76] Inventor: Warren Osborn, 23 Brinker Rd., Barrington Hills, Ill. 60010

[21] Appl. No.: 278,386

[22] Filed: Jul. 21, 1994

Related U.S. Application Data

[63] Continuation of Ser. No. 876,321, Apr. 30, 1992, abandoned.

[51] Int. Cl.[6] ..... B05F 3/02

[52] U.S. Cl. ..... 414/408; 414/406; 414/421; 414/409

[58] Field of Search ..... 414/403, 404, 406, 407, 414/408, 409, 546, 414, 419, 420, 421, 422, 423, 424, 425, 486, 487

[56] References Cited

U.S. PATENT DOCUMENTS

| | | | |
|---|---|---|---|
| 3,658,199 | 4/1972 | Owen, Jr. | 414/425 |
| 3,702,662 | 11/1972 | Davieau | 414/406 X |
| 4,575,300 | 3/1986 | George | 414/406 |
| 4,580,940 | 4/1986 | Sheaves | 414/406 |
| 4,960,355 | 10/1990 | Worthington | 414/408 X |
| 5,006,030 | 4/1991 | Smith et al. | 414/408 |

FOREIGN PATENT DOCUMENTS

| | | | |
|---|---|---|---|
| 1298445 | 6/1969 | Germany | 414/408 |
| 2716656 | 10/1978 | Germany | 414/408 |
| 569797 | 11/1957 | Italy | 414/421 |
| 763204 | 9/1980 | U.S.S.R. | 414/408 |

*Primary Examiner*—Frank E. Werner

[57] ABSTRACT

The apparatus of the present invention uses fluid motor driven rotating hooks mounted within the rear opening of a refuse collection vehicle. These hooks grasp and lift dumpsters by their trunnion bars and pull them into the vehicle. Following the initial hook motion, a lever pivots upwardly to invert the receptacle and empty its contents. In another feature, there is provided an accessory for attachment to the rotating hooks fcr grasping and dumping smaller containers. This device uses a cam-actuated mechanism that operates during initial rotation of the hooks. The cam actuates linkage which grasps the lower handle of the container and the complete rotation of the hooks inverts the container.

7 Claims, 4 Drawing Sheets

APPARATUS FOR LIFTING AND DUMPING A RECEPTACLE

This application is a continuation of Ser. No. 07/876,321 filed Apr. 30, 1992, now abandoned.

BACKGROUND OF THE INVENTION

Field of the Invention

This invention relates to apparatus for lifting and dumping a receptacle during trash collection. More particularly this invention relates to apparatus for efficiently dumping a container, such as a dumpster, into a refuse gathering vehicle having a rear opening.

Description of the Prior Art

Large receptacles, generally referred to as dumpsters, have been difficult to efficiently dump into refuse collection vehicles. These dumpsters present laterally extending bar members (referred to as trunnion bars) from their upper front, and these bars are used to grasp, lift and dump the container in cooperation with a lower foot member. Prior systems have generally required operator intervention to attach the dumpster to the lifting apparatus. Chains are extended from the vehicle to hook onto the trunnion bars, and retraction of the chains pulls the dumpster into the vehicle cavity.

SUMMARY OF THE INVENTION

Accordingly, it is a principal objective of the present invention to provide an effective dumping apparatus which allows automatic grasping and inversion of the dumpster without operator intervention.

The apparatus of the present invention uses rotating hooks mounted within the rear opening of the vehicle and extending outwardly therefrom. Rotation of the hooks engage the trunnion bars of the dumpster such that the receptacle is lifted and pulled into the opening by the hooks. Following the initial hook motion, a lower foot pivots upwardly to complete the inversion of the receptacle and empty its contents.

In another feature, there is provided an accessory for attachment to the rotating hooks for grasping, and dumping smaller containers. This device uses a cam-actuated mechanism that operates as the hooks rotate. The cam actuates linkage which operates to grasp the lower handles of this container during movement into the rear opening. Complete rotation of the hooks completes the inversion of the container.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
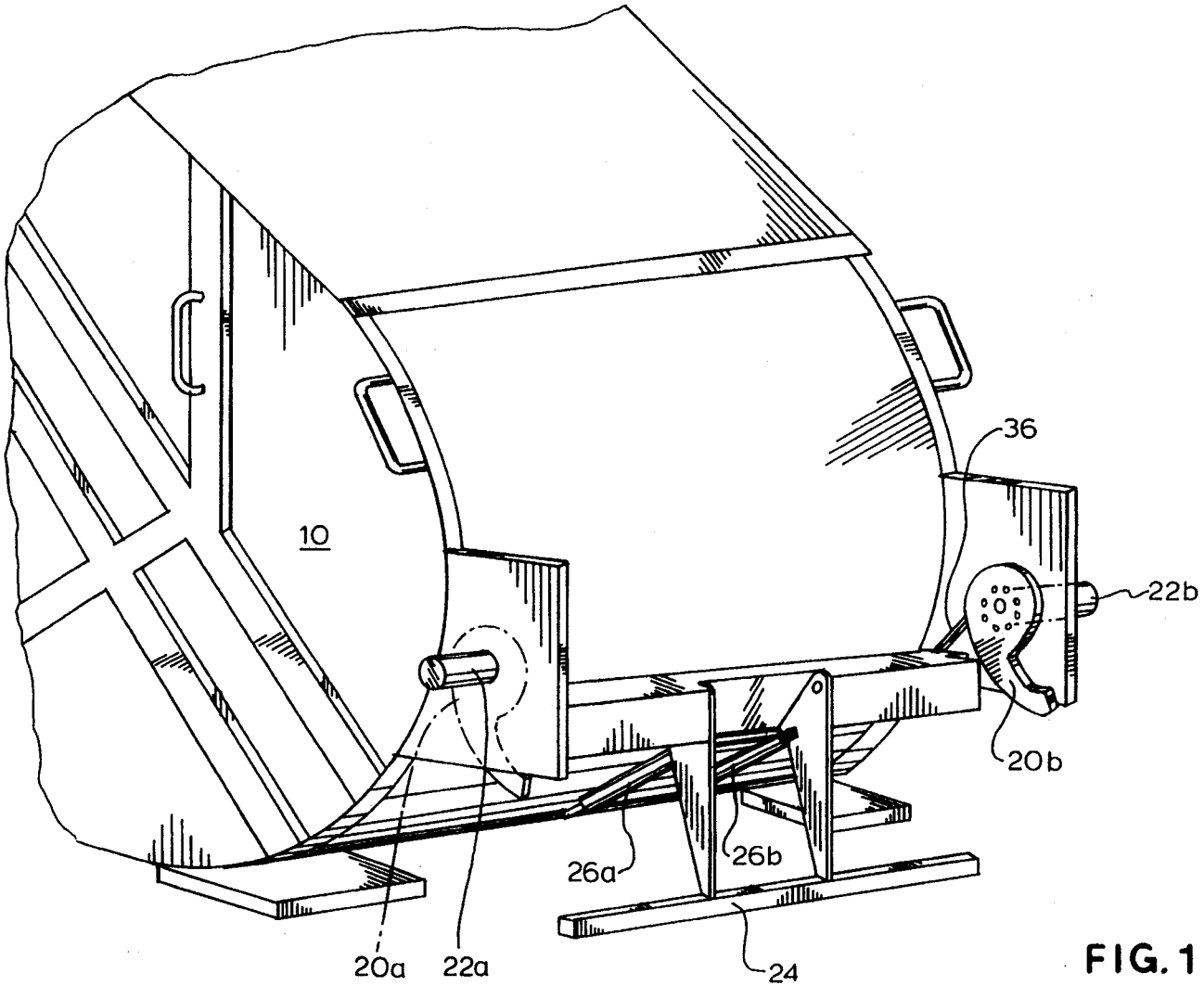
FIG. 1 is a pictorial view of a receptacle dumping apparatus accordance with the present invention.
Figure 2:
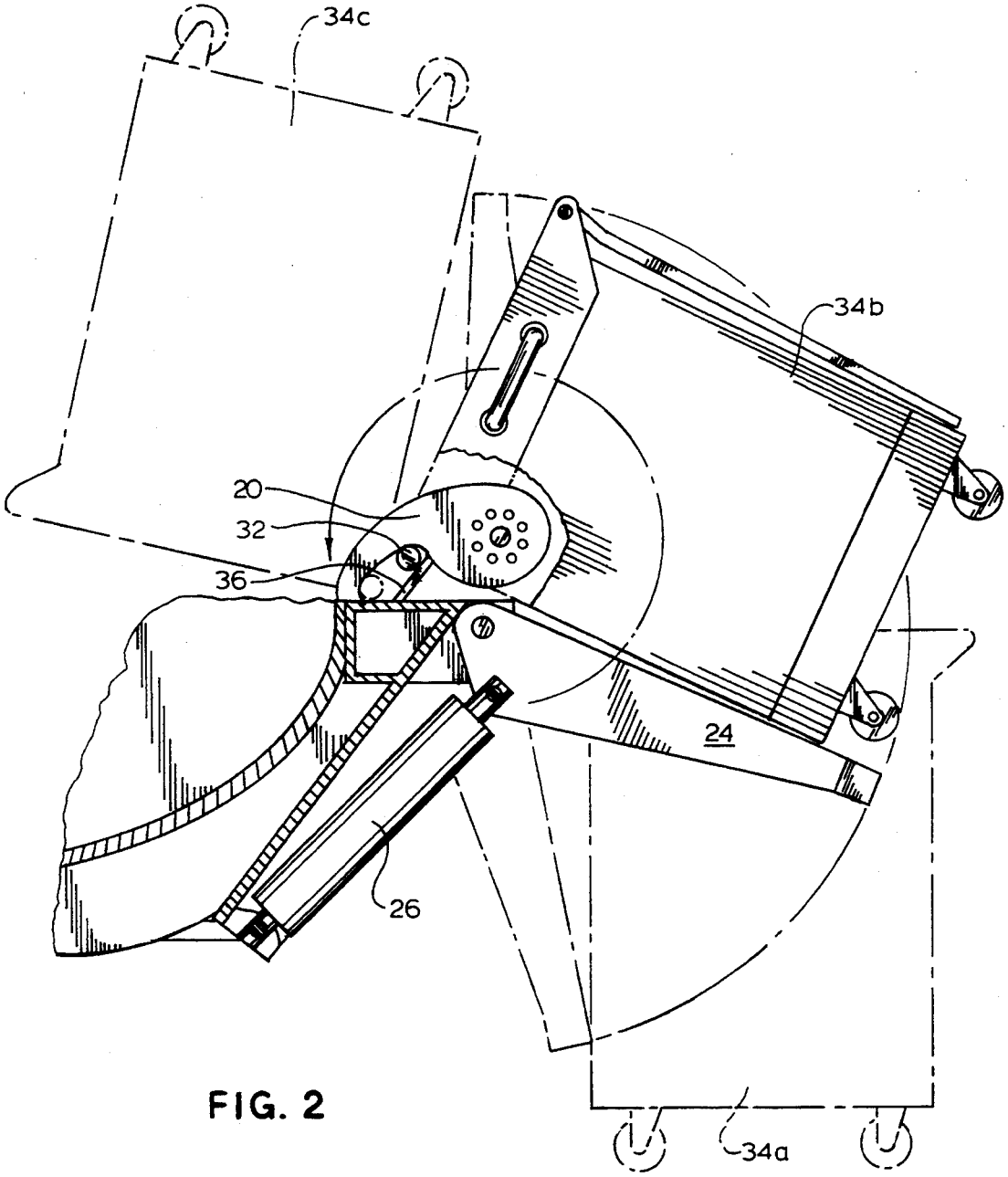
FIG. 2 is a side elevational view of the apparatus of FIG. 1 showing the sequence of the dumping operation.

Turning first to FIG. 1, there is shown a commonly known refuse collection vehicle 10 having a rear opening thereto. Mounted for rotation on the inside wall on each side are hook members 20*a* and 20*b*. These members are eccentrically mounted with an elongated hook extending therefrom. Selective rotation of the hooks are accomplished by use of fluid motors 22*a* and 22*b* connected to the hydraulic lines of the vehicle. Additionally, a lower foot member 24 is pivotally mounted to the lip of the rear opening and driven by fluidic cylinders 26*a* and 26*b* to complete the inversion of the dumpster as described in detail below.

The refuse collection vehicle is first moved into contact with the dumpster, allowing the hook members 20*a* and 20*b* to extend under the trunnion bars 32 extending from the dumpster. Fluid power is then applied to the fluid motors 22*a* and 22*b* causing the hooks to rotate. This rotation initially lifts the dumpster (position 34*a*), then draws the dumpster into the vehicle opening (position 34*b*), positioning the trunnion bars against the stop 36. At this point the rotational position of the hooks is sensed and the fluid power is directed to the cylinders 26*a* and 26*b* to drive the foot 24 upward against the dumpster and to ultimately invert it (position 34*c*). The hydraulic circuitry to accomplish the above actuation is not specified herein as it is well within the capabilities of one skilled in the art.

Figure 3:
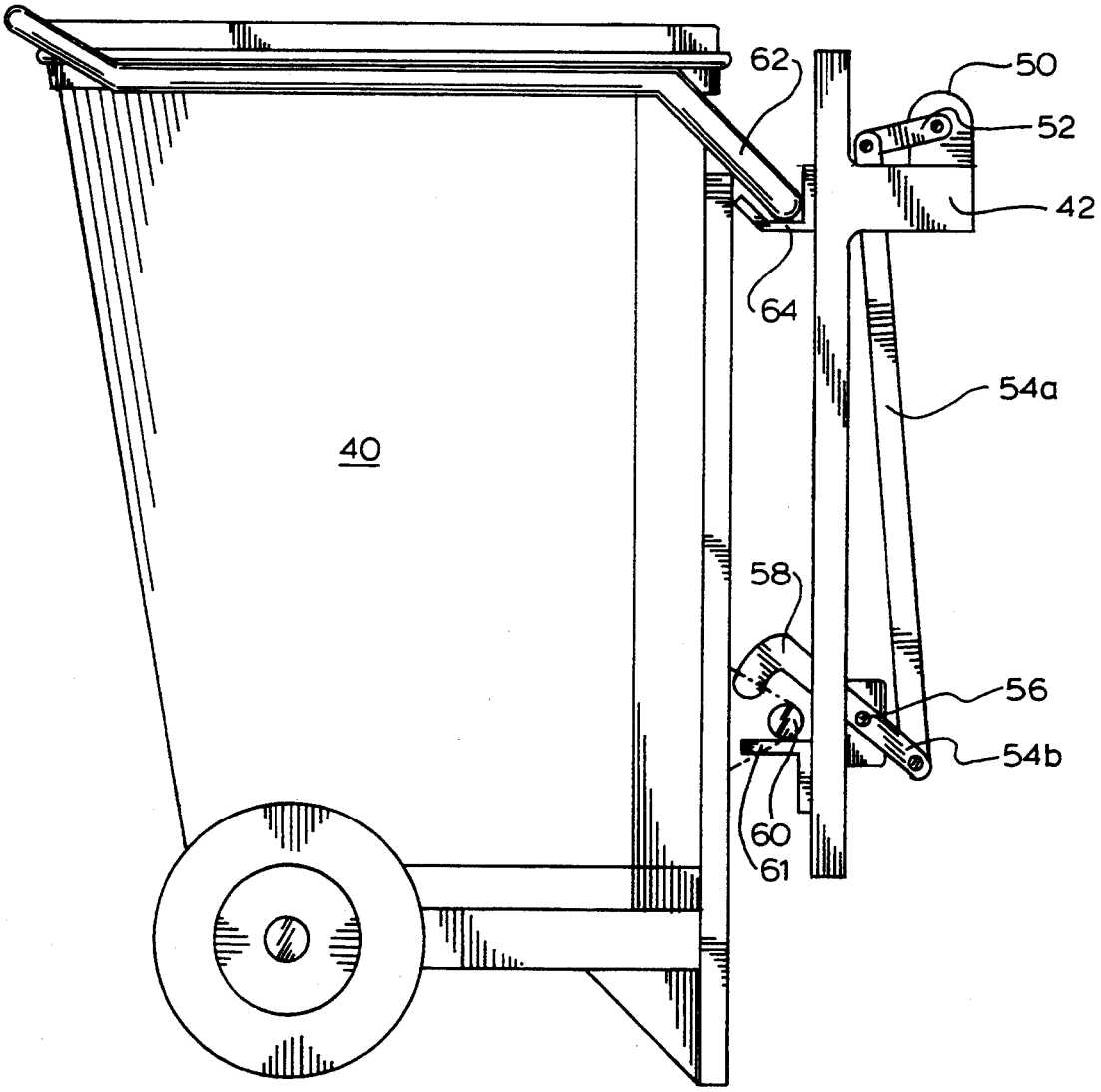
FIG. 3 is a side view of an attachment device for the apparatus of FIG. 1 for dumping smaller containers.
Figure 4:
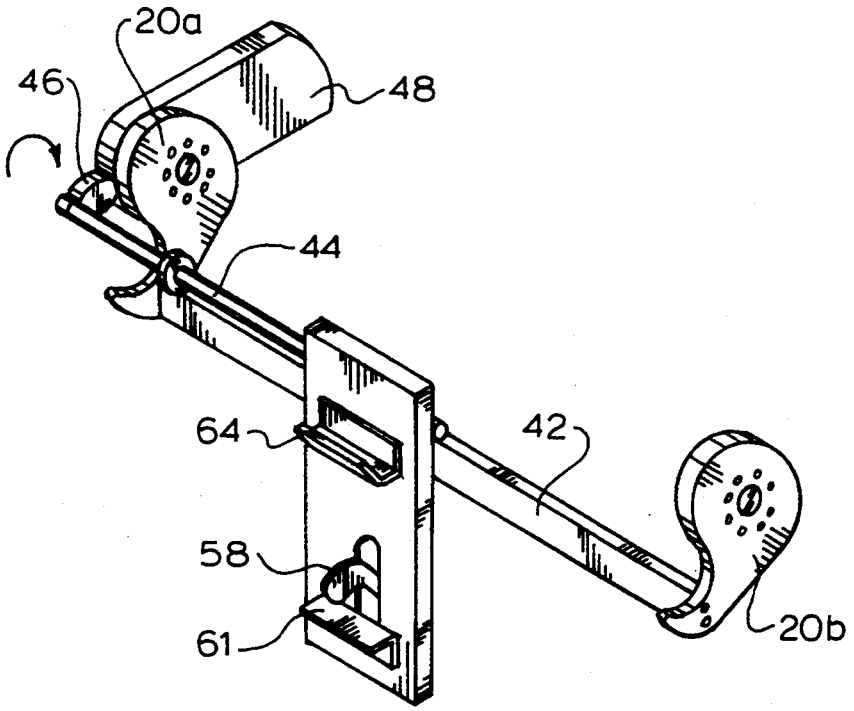
FIG. 4 is a pictorial view of the cam actuation of the device of FIG. 3.

Turning now to FIGS. 3 and 4, there is shown an attachment to the hook mechanism of FIG. 1 to facilitate lifting and dumping of smaller containers 40. This attachment employs a mounting bar 42 spanning the rear opening of the vehicle and (removeably) secured to the hook members 20*a* and 20*b*. An actuating bar 44 extends along the upper surface of the mounting bar and carries a pawl 46 at its extremity positioned to ride against a cam 48 secured to the side of the vehicle opening. The other end of the actuating bar 44 passes through a bearing mount 50 (FIG. 3) and is affixed to an actuating lever 52. This lever in turn controls linkage 54*a* and 54*b* in response to rotation of the actuating bar.

Operation of the linkage occurs when the hook members are driven by the fluid motors as previously described. As rotation begins, the pawl 46 contacts the cam 48 and is forced to rotate downwardly as shown. This rotation forces actuating lever 52 (FIG. 3) to pull upwardly on the linkage 54*a*, to force linkage 54*b* to rotate about its pivot 56 is 58 closes over the lower handle 60 of the container to restrain it against the lower support 61. At the top of the container, the upper handle 62 is cradled by a support 64.

When the hooks 20*a* and 20*b* are rotated, the handles of the container are grasped securely by the supports and by operation of the linkage while the apparatus is rotated to initially position the container into the dumpster. Further rotation of the hook members completes the inversion of the container to dump its contents into the vehicle cavity.

From the foregoing description, it will be apparent that modifications can be made to the apparatus and method for using same without departing from the teachings of the present invention. Accordingly, the scope of the invention is only to be limited as necessitated by the accompanying claims.

I claim:

1. An apparatus for a refuse collection vehicle having a rear opening thereto for dumping a receptacle; said receptacle having contents therein to be dumped into said refuse collection vehicle; said receptacle further having a top, a front, and a pair of oppositely disposed sides with bar members being receivable within said rear opening and extending outwardly from said sides adjacent to said top and said front of said receptacle, said apparatus comprising:

a pair of selectively rotatable hook members being mounted on a coextensive axis and oppositely disposed within said rear opening of said refuse gathering vehicle at each side thereof and providing a cam actuation for inverting said receptacle;

means for selectively causing rotation of said hook members, whereby said bars extending from said receptacle are engaged by said rotatable hook members, thereby causing said receptacle to be pulled forward of and lower than said coextensive axis into said rear opening;

means for elevating and rotating said receptacle;

said means for completing a rotation of said receptacle comprises a lever member;

said lever member is pivotally mounted to said vehicle beneath said rear opening; and said lever member and said hook members cooperate to invert said receptacle forward of and lower than said coextensive axis, whereby said contents of said receptacle may be substantially received within said rear opening.

2. The apparatus of claim 1 wherein said hook members are driven by fluid powered motors.

3. The apparatus of claim 1 wherein said lever member is pivoted by fluid piston and cylinder means.

4. The apparatus of claim 1 wherein said hook members are driven by fluid powered motors; said means for elevating and rotating said receptacle comprises said lever member pivotally mounted to said vehicle beneath said rear opening and pivoted by fluid piston and cylinder means; and further comprising means to sense the rotation of said hook members and to actuate said lever member subsequent to said rotation of said hook members.

5. In an apparatus for dumping a receptacle into a refuse collection vehicle comprising:

said refuse collection vehicle having a rear opening therein;

said receptacle having contents to be dumped into said collection vehicle;

said receptacle further having a top, a front, and a pair of oppositely disposed sides with a first bar member and a second bar member being receivable within said rear opening;

said first bar member and said second bar member being oppositely disposed and extending outwardly from said sides adjacent to said top and said front of said receptacle; and said apparatus further comprising a first means for elevating said receptacle:

the improvement comprising:

a first selectively rotatable hook member and a second selectively rotatable hook member being mounted on a coextensive axis and oppositely disposed within said rear opening of said refuse gathering vehicle at each side thereof in order to provide a cam actuation for inverting said receptacle;

said cam actuation causing said receptacle to be elevated, drawn forward and rotated down into a locked position, thereby pivoting said receptacle over said rear opening and forward of and lower than said coextensive axis;

said first selectively rotatable hook member and said second selectively rotatable hook member being spaced apart;

means for engaging said first bar member with said first hook member and said second bar member with said second hook member;

means for pulling said receptacle into said rear opening;

means for selectively causing rotation of said first hook member and said second hook member; and said first means for elevating said receptacle cooperating with said first hook member and said second hook member to invert said receptacle, pull said receptacle forward and lower than said coextensive axis, whereby said contents of said receptacle may be substantially received within said rear opening.

6. The apparatus of claim 5 wherein said first means for elevating said receptacle comprises a lever member pivotally mounted to said vehicle beneath said rear opening.

7. The apparatus of claim 5 wherein:

said hook-members are driven by fluid powered motors;

said first means for elevating said receptacle comprises a lever member being pivotally mounted to said vehicle beneath said rear opening and pivoted by fluid piston and cylinder means; and means to sense a rotational position of said hook members and to actuate said lever member subsequent to said rotation of said hook members.

* * * * *